United States Patent [19]

Ellersick

[11] 4,349,724

[45] Sep. 14, 1982

[54] ARTICULATE RADIANT HEATER MODULE

[76] Inventor: Russell Ellersick, 7925 Twin Oaks Dr., Citrus Heights, Calif. 95610

[21] Appl. No.: 204,760

[22] Filed: Nov. 7, 1980

[51] Int. Cl.[3] ..... H05B 1/00

[52] U.S. Cl. ..... 219/347

[58] Field of Search ..... 219/339–358, 219/405, 411, 525

[56] References Cited

U.S. PATENT DOCUMENTS

| | | | |
|---|---|---|---|
| 775,105 | 11/1904 | Edmands et al. | 219/525 |
| 2,317,426 | 4/1943 | Wilson | 219/342 |
| 2,497,676 | 2/1950 | Lashells | 219/347 |
| 2,610,280 | 9/1952 | Wilson | 219/349 |
| 3,731,051 | 3/1971 | Ellersick | 219/347 |

FOREIGN PATENT DOCUMENTS

| | | | |
|---|---|---|---|
| 364275 | 11/1922 | Fed. Rep. of Germany | 219/348 |
| 55-41367 | 3/1980 | Japan | 219/345 |
| 115843 | 11/1925 | Switzerland | 219/345 |

*Primary Examiner*—Bernard Roskoski

*Attorney, Agent, or Firm*—Mark C. Jacobs

[57] ABSTRACT

A radiant heater modules comprises a plurality of quartz iodide bulbs projecting from an air cooled housing and a reflector to direct heat from the bulbs toward the pipe. This housing is of a generally box-like configuration and includes a top cover plate. The bulbs are mounted in sockets which are attached to the bottom side of the top cover plate and the sockets are electrically connected to a plug which is fixedly attached to the top side of the top cover plate. Means are also provided for rigidly securing the housing to the reflector.

6 Claims, 3 Drawing Figures

ARTICULATE RADIANT HEATER MODULE

BACKGROUND OF THE INVENTION

This invention relates to electrical heating apparatus and, more particularly, to apparatus for applying radiant heat uniformly to any one of a variety of differently contoured workpieces, such as the circumferences of large pipes for the purpose of relieving weld stresses in the pipe weld.

The uniform intense heating of a preselected portion of a large workpiece by known techniques presents several difficulties in that the apparatus may be massive and non-portable, the apparatus may be contoured to heat only a single shape and size of workpiece, the available temperatures may be limited to about 1500° F. hot spots and other non-uniform heating effects may occur, and the entire assembly may become heated. All of these difficulties may be visualized readily by contemplating, for example, the thermal stress relieving at 1300° F. of a welded joint between the abutting ends of two large pipes having, say, 6 foot diameters and wall thicknesses of 5 inches. Since rate of temperature rise and uniformity of temperature at all circumferential points must be closely controlled it is apparent that the size and mass of such a workpiece presents significant heat control problems.

In U.S. Pat. No. 3,731,051 to R. P. Ellersick, the subject matter of which is incorporated herein by reference, there is described a heating apparatus and method which overcomes the above disadvantages to a large degree as a result of the use of special modular heat generating units linked together in end-to-end relationship to form a chain-like assembly. The assembly is made up of an appropriate number of modules at the work site and then conformed to the contour of the workpiece, as by being wrapped about the circumference of a pipe to be heated. Each module comprises a radiant heating means, preferably in the form of a group of quartz iodide lamps, projecting from an air cooled housing in which the bases of the bulbs are supported and a reflector to direct heat from the bulbs toward the pipe. The quartz iodide lamps are capable of emitting high intensity radiant heat in a range of wavelengths near infra-red but sufficiently outside the latter that the escaping light rays are not harmful to the eyes. It has been found that this type of radiant heat can be rather easily controlled to give substantially more rapid heat penetration into the workpiece and greater uniformity of temperature within the workpiece than can be obtained with, for example, a resistance heater disposed in the same relative position.

In one embodiment that is disclosed the housings containing the quartz iodide lamps are joined together in end-to-end relationship to form the chainlike assembly and in another embodiment the reflections are jointed together in end-to-end relationship to form the chain like assembly. The housing portion of the module is the same in both embodiments.

Although the modules constructed as described in the above cited patent have performed in a generally satisfactory manner it has proven to be somewhat involved in disassemblying the housing portions if a lamp or a lamp socket needs to be replaced. Also, it has been found that since lamp sockets are partly exposed they are susceptible to being broken if accidently hit. Furthermore, improvement is needed in the internal electrical wiring arrangement. In addition, no means are provided for quickly disconnecting the module from its power source. Finally, when the modules are connected end-to-end by their reflectors, no means are provided for rigidly securing the housings to the reflectors.

It is the general purpose of this invention to provide a heater module of the type described in the above cited patent which overcomes the above noted shortcomings.

SUMMARY OF THIS INVENTION

A heater module constructed according to the teachings of this invention includes a plurality of quartz iodide bulbs projecting from an air cooled housing and a reflector to direct heat from the bulbs toward the pipe. This housing is of a generally box-like configuration and includes a top cover plate. The bulbs are mounted in sockets which are attached to the bottom side of the top cover plate and the sockets are electrically connected to a plug which is fixedly attached to the top side of the top cover plate. Means are also provided for rigidly securing the housing to the reflector.

IN THE DRAWINGS

The invention will be further understood from the following detailed description taken with the drawings in which.

DESCRIPTION OF PREFERRED EMBODIMENT

Figure 2:
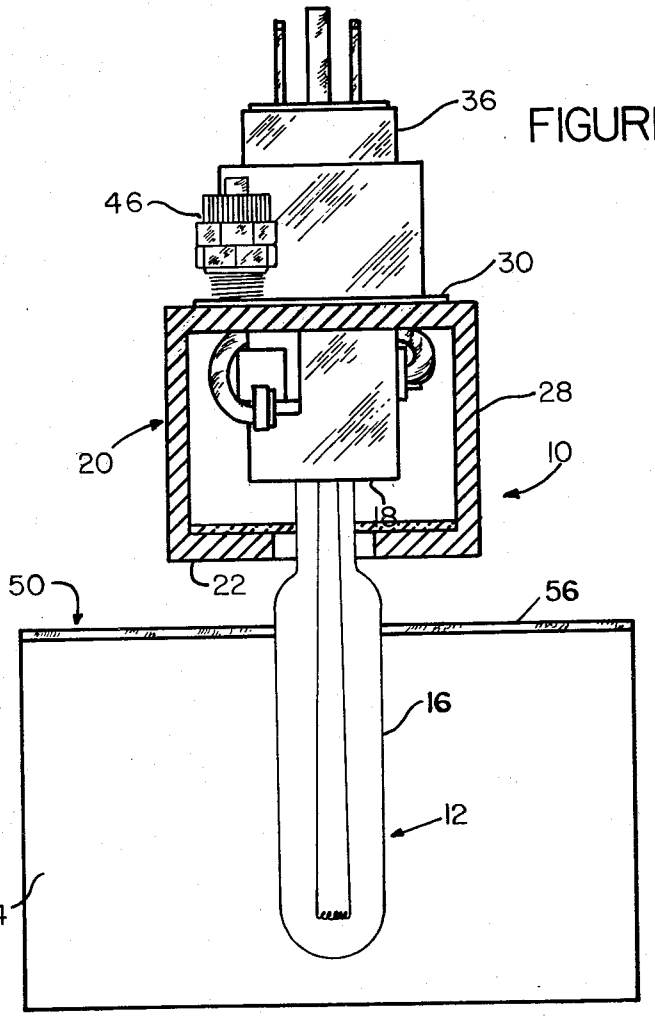
FIG. 2 is a side view of the module of FIG. 1.
Figure 1:
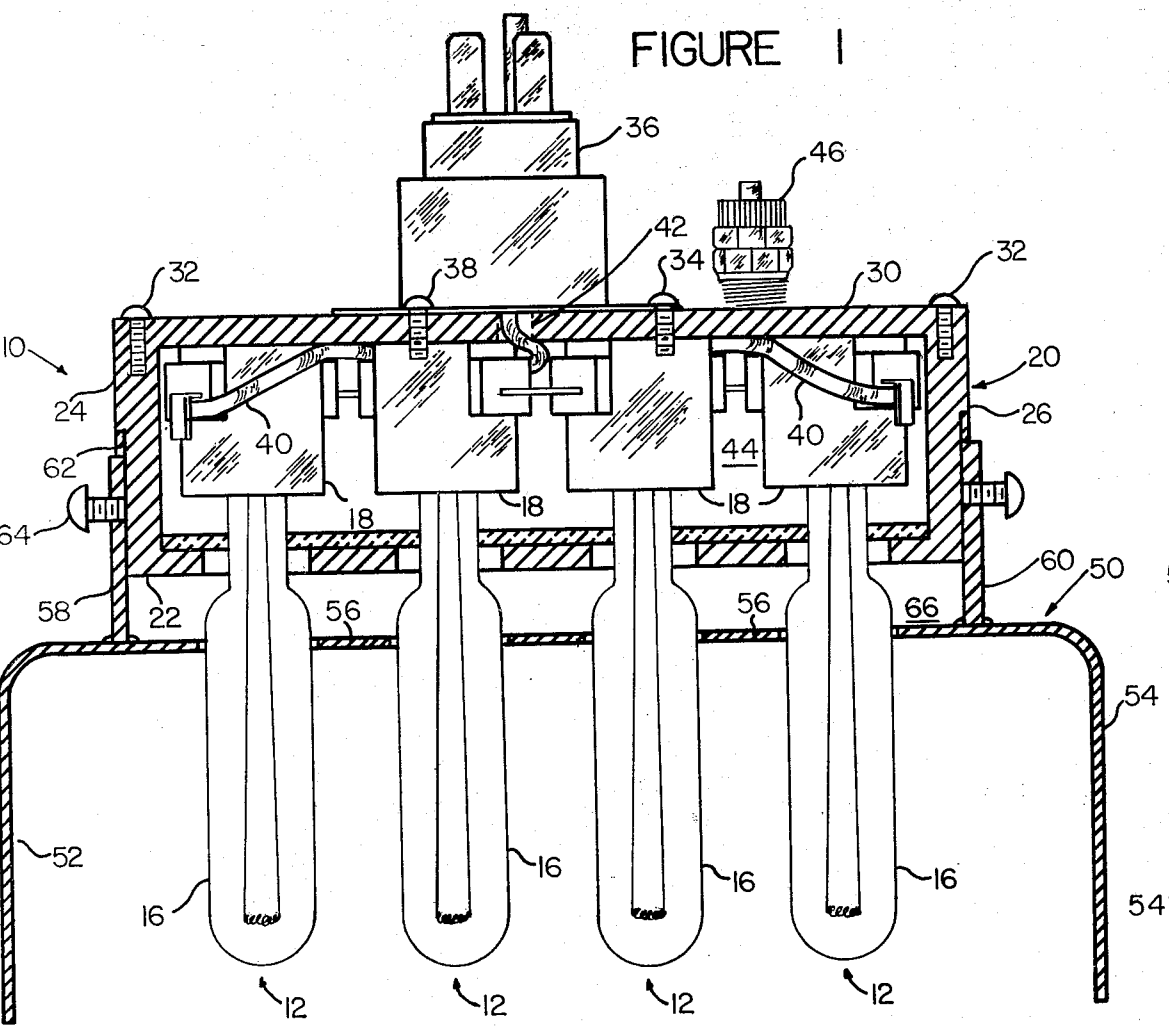
FIG. 1 is an elevational view, partly broken away, of a heat-generating module embodying the principles of the present invention.

Referring to FIG. 1 there is shown a heat-generating module 10 which includes a plurality of heating elements in the form of four quartz iodide lamps 12 having base portions and elongated bulb portions 16. The lamps 12 are arranged parallel to each other in a common plane with their base portions supported by sockets 18 located within a housing 20 and the bulb portions 16 exending from the housing 20. As can be seen, housing 20 has a generally box-like configuration and includes a bottom wall 22, end walls 24 and 26, a rear wall 28 and a removable top cover plate 30 which is attached to the top surfaces of the end walls 24 and 26 by means of screws 32. A plurality of sockets 18 are mounted on the bottom side of top cover plate 30 and secured thereto by means of screws 34. Current for the lamps 12, which are connected in series, is supplied through a plug 36 which is adapted to be connected to an external power source (not shown). Plug 36 is mounted on the top side of top cover plate 30 and secured thereto by means of screws 38. Thus, no wires extend out from the housing 20. Plug 36 is connected to sockets 18 through wires 40 which extend up through a hole 42 in top cover plate 30.

Bottom wall 22, end walls 24 and 26, rear wall 28 and top cover plate 30 together form a chamber 44 which contains sockets 18 and also forms a plenum for receiving a supply of pressurized cooling air which is required for maintaining the temperature of the sockets 18 and lamp base portions sufficiently low to prevent damage thereto. Air is supplied to the chamber 44 through a coupling 46 and flows downwardly between each socket 18 and the bottom wall 22 of the housing 20. The bottom wall 22, which is of thick construction so as to absorb heat, is provided with a plurality of openings 48 through which the lamps 12 extend.

Heating module 10 also includes a radiant heat reflector 50 which is of rectangular box-like shape having an open bottom so that heat from lamps 12 is reflected out in a direction along the longitudinal axis of lamps 12 a pair of side walls 52 and 54 and a top wall 56 which is slightly larger in length than housing 20 and which is provided with a plurality of openings 57 through which lamps 12 extend. Reflector 50 is mounted on housing 20 by means of brackets 58 and 60 which are welded or otherwise rigidly secured to the top wall 56 of reflector 50 and fit into recessed portions 62 formed on the end walls 24 and 26 of housing 20. Reflector 50 is fixedly secured to housing 20 by means of adjustable screws 64 on brackets 58 and 60. A space 66 is intentionally provided between the bottom of housing 20 and the top of reflector 50 to permit escape of cooling air in a lateral direction.

Figure 3:
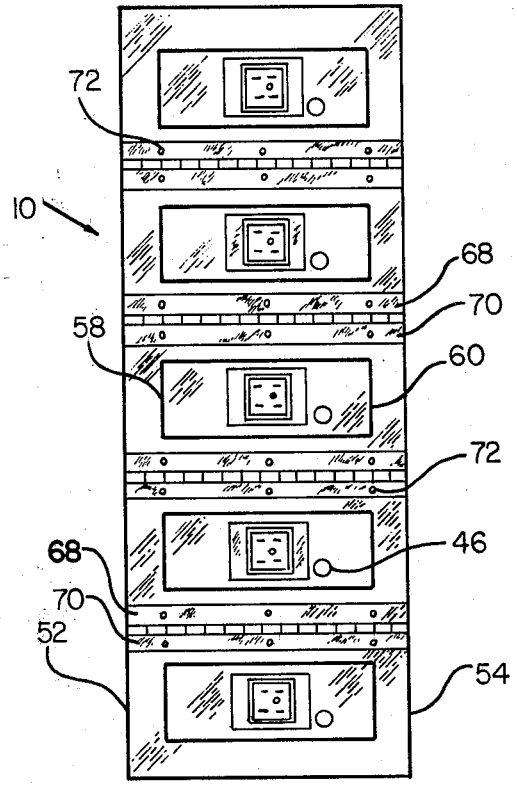
FIG. 3 is a plan view of an assembly of modules of the type illustrated in FIG. 1.

Module 10 also includes articulated connection means so that each end of one module can be attached to one end of an identical module. The articulated connection means as shown in FIG. 3, comprises opposite halves 68 and 70 of a hinge attached to the front and rear edges of the top wall 58 by means of screws 72.

The inner surfaces of the reflector 50 are coated with a layer of reflective, heat-resistant, insulating material, 4 which protects the reflector from overheating and reflects most of the radiant energy.

Modules 10 may be used in the same manner as the modules described in the above noted U.S. Pat. No. 3,731,051.

The disclosure of U.S. Pat. No. 3,731,051 is incorporated herein by reference. The modules of this invention can likewise be used in the plurality in conjunction with an electrical junction box and power controllers to limit the power to each module to control heat to particular individual modules.

Optionally, in the space between reflector 50, and module 4, there may be disposed a batt of insulation material not shown such as Kaowool made by Babcock & Wilcox. While allowing the air to escape from the module, as previously indicated, the butt also serves to prevent light from the bulbs from impinging upon the module, thus extending the life of the module.

In placing the batt into position on the top 30 of module 10, apertures are punched for the bulbs to go through such that they can be inserted into the sockets 18.

It is seen that the construction of the instant modules is not only easier and cheaper for the manufacturer, but also provides some unobvious benefits to users of the module. Since the sockets 18 are secured to the underside of top cover plate 30, should a socket short out or otherwise become inoperable, it is a simple thing to remove the top plate 30 and replace the entire cover plate-sockets assembly.

In addition, the module operates cooler since large metal masses are not present in vicinity surrounding the sockets, as in the prior art modules. Further, the use of a severable plug and cable render the module much more mobile. Cable and sockets are often available at job sites, thus negating the necessity of bringing some to the work area. Modules can be packed away easily in briefcases at the end of the business day if such is desired from an anti-theft point of view, or from a mere mobility point of view wherein they may be required at another job site the next day. Maintenance of an array of modules is also improved in that formerly a plurality of these were gorg-wired together for usage. Now each unit can be plugged in and removed at will. This is beneficial to the operator.

It will be apparent that the linked-module concept is not limited to cylindrical workpieces and hasutility in connection with a wide variety of shapes, including flat elongated workpieces. The principal advantages of the technique is that the heating apparatus is readily portable and is readily adapted to a variety of sizes and shapes of workpieces, because the modules are connected together at the site to fit the particular workpiece.

Since certain changes may be made in the above apparatus without departing from the scope of the invention herein involved, it is intended that all matter contained in the above description and shown in the accompanying drawings shall be interpreted as illustrative and not in a limiting sense.

What is claimed is:

1. A radiant heating module comprising a box-shaped housing having a bottom wall, a pair of opposed parallel end walls, a front wall, a back wall and a removable top cover plate, one of said walls having a plurality of openings, a plurality of lamp sockets attached to the bottom side of the top cover wall, each socket being disposed within said housing, each of said sockets being aligned with one of said openings to permit lamp placement in said sockets, a lamp in each of said sockets, said lamp extending axially from said socket through its respective aperture to a position outside of said housing means connecting the lamp sockets to a source of electrical current: a reflector removably secured to the housing having a first wall parallel to and spaced from the wall of said housing having the plurality of openings: said reflectors first wall also having a plurality of openings therein, each of which openings is axially aligned with the corresponding opening of the housings, said reflector also having parallel side walls and articulated connection means on said module for attaching one end of said module to one end of a similar module.

2. The radiant heater module of claim 1 wherein the means connecting the lamp sockets to the source of electrical current includes a plug whose prongs extend outwardly from said housing, and which plug is attached to the top side of the top cover plate.

3. The radiant heater module of claim 1 and wherein the openings in one of the walls of the housing are in the bottom wall.

4. The radiant heater module of claim 1 and wherein the reflector is removably attached to the housing.

5. The radiant heater of claim 1 and wherein the articulated connection means comprises opposite halves of a hinge attached to opposite edges of the reflector.

6. The device of claim 4 wherein the reflector is lined on the inside with a reflective heat-resistant insulating material.

* * * * *